US009359752B2

(12) United States Patent
Le et al.

(10) Patent No.: US 9,359,752 B2
(45) Date of Patent: Jun. 7, 2016

(54) TOILET DISCHARGE VALVE ASSEMBLY HAVING MOVEABLE BUOYANT FLOAT THEREIN

(71) Applicant: FLUIDMASTER, INC., San Juan Capistrano, CA (US)

(72) Inventors: Tuan Le, Fountain Valley, CA (US); Steve Cook, Oceanside, CA (US); Adam Sampson, Ramona, CA (US)

(73) Assignee: Fluidmaster, Inc., San Juan Capistrano, CA (US)

( * ) Notice: Subject to any disclaimer, the term of this patent is extended or adjusted under 35 U.S.C. 154(b) by 457 days.

(21) Appl. No.: 13/943,991

(22) Filed: Jul. 17, 2013

(65) Prior Publication Data

US 2014/0026309 A1 Jan. 30, 2014

Related U.S. Application Data

(60) Provisional application No. 61/775,398, filed on Mar. 8, 2013, provisional application No. 61/760,851, filed on Feb. 5, 2013, provisional application No. 61/675,642, filed on Jul. 25, 2012.

(51) Int. Cl.
*E03D 1/14* (2006.01)

(52) U.S. Cl.
CPC ..... *E03D 1/142* (2013.01)

(58) Field of Classification Search
CPC ..... E03D 1/142; E03D 1/33; E03D 1/34; E03D 1/304; E03D 3/12; E03D 5/02; E03D 5/024; F16K 31/18
USPC ..... 4/324, 325, 391, 395, 398, 407
See application file for complete search history.

(56) References Cited

U.S. PATENT DOCUMENTS

| | | | |
|---|---|---|---|
| 3,662,408 | A | 5/1972 | Knudtson |
| 3,987,501 | A | 10/1976 | Anderson |
| 4,149,283 | A | 4/1979 | Knudtson |

OTHER PUBLICATIONS

International Search Report, Dec. 2, 2013, PCT.

*Primary Examiner* — Tuan N Nguyen
(74) *Attorney, Agent, or Firm* — Gordon Rees Scully Mansukhani LLP

(57) ABSTRACT

A toilet flush valve that has a moveable buoyant float therein, wherein the float has an open bottom end to trap air therein and wherein the housing includes controls to selectively release air to allow the float to move upwardly therein to permit flushing. By timing when one or two air vents on the housing are open, the duration and volume of the flush can be controlled, with the buoyancy provided by the water lifting the float to open the flush valve. This provides a flushing system with minimal activation energy.

27 Claims, 21 Drawing Sheets

TOILET DISCHARGE VALVE ASSEMBLY HAVING MOVEABLE BUOYANT FLOAT THEREIN

RELATED APPLICATIONS

The present invention claims priority to U.S. Provisional Patent Application Ser. No. 61/775,398, entitled DISCHARGE VALVE USING AIR HOUSING WITH MOVEABLE FLOAT THEREIN, filed Mar. 8, 2013; and to U.S. Provisional Patent Application Ser. No. 61/760,851, filed Feb. 5, 2013 entitled DISCHARGE VALVE UTILIZING POTENTIAL AND KINETIC ENERGY OF FLUID FLOW; and to U.S. Provisional Patent Application Ser. No. 61/675,642, entitled DISCHARGE VALVE UTILIZING POTENTIAL AND KINETIC ENERGY OF FLUID FLOW, filed Jul. 25, 2012; the entire disclosures of which are incorporated herein by reference in their entirety.

TECHNICAL FIELD

The present invention relates to toilet discharge valve assemblies, including both partial and full-flush designs.

BACKGROUND OF THE INVENTION

Numerous discharge (i.e.: flush) valve systems currently exist. All of these systems use various actuators that mechanically cause the flush valve to open and close. Some of these designs selectively permit either partial flushing or full flushing. Although many of these designs are generally acceptable, they often require considerable energy to operate their actuators.

What is instead desired is a discharge flush valve system that requires only minimal energy to operate. The present invention provides such a system. This is because the present system uses the buoyancy of the water itself in the toilet tank to control the operation of the discharge valve flushing.

SUMMARY OF THE INVENTION

The present invention provides a discharge valve assembly that uses the water's own buoyancy in conjunction with an air release mechanism to turn on and off the flushing.

In one preferred aspect, the present invention provides a flush valve, comprising: (a) a housing dimensioned to be positioned over a drain in a toilet tank; (b) a float assembly being vertically moveable within the housing, the float assembly configured to seal the drain when the float assembly is in a lowered position, and to open the drain when the float assembly is in a raised position, wherein the float assembly comprises a hollow float having an open bottom end to trap air therein, and wherein an air chamber is formed between the interior of the housing and the exterior of the float assembly; (c) an air passageway connecting the air chamber in the housing to external ambient air; and (d) an actuator for selectively opening and closing the air passageway.

The float is similar to an upside-down cup. In operation, air becomes trapped inside the float with air entering under the bottom of the float at the end of a flush. This causes the float to become buoyant (when later surrounded by water). However, air trapped in a chamber in the housing above the float keeps the float in its "pre-flush" lowered position, thereby sealing the drain. At this "pre-flush" time, the float is surrounded by water. By releasing air trapped above the float in the housing, the buoyant float then lifts while the tank water flows underneath the float and into the drain, thereby flushing the toilet. The air passageway out of the housing can be selectively opened and closed. Opening the air passageway lets air escape from the housing, thus causing the buoyant float to rise. As the tank water passes under the float and down the drain, the water level drops and the float becomes less buoyant. The float will therefore naturally fall back down to seal the drain. However, in an alternate aspect, air is prevented from re-entering the space in the housing above the float after the float has lifted. This will keep the float at a raised position, thereby prolonging the duration of the flush.

The advantage of the present system is that it uses very, very little energy to operate. Simply by opening and closing an air vent at proper times, the flushing of the toilet bowl can be activated, and the duration of the flush can easily be controlled. Moreover, there is no need to pump air into the valve assembly. Rather, air simply enters the valve assembly when the water leaves the tank during a flush. Thus, the system is always ready for re-use for one flush after another.

In its various preferred embodiments, systems are also provided to have air enter the housing at more than one height such that the buoyancy (and movement) of the float within the chamber can be controlled. Specifically, when air is permitted to enter the housing at a higher location, the float will fall sooner, thus providing a half flush. Blocking this air path will cause the air to enter the housing later, thus providing a full flush.

In addition, in various preferred embodiments of the invention, a venting path between the interior of the float and the ambient air outside the housing is provided. This venting path system has the advantage of keeping the buoyancy of the float constant as the height of the water in the tank around the float changes.

BRIEF DESCRIPTION OF THE DRAWINGS

FIG. 16 B is a perspective view of an alternate embodiment of the present invention in a flush mode.

DETAILED DESCRIPTION OF THE DRAWINGS

FIGS. 1 to 5 show the operation of a simplified embodiment of the invention such that the advantages of present the buoyant float can clearly be understood, as follows.

Figure 1:
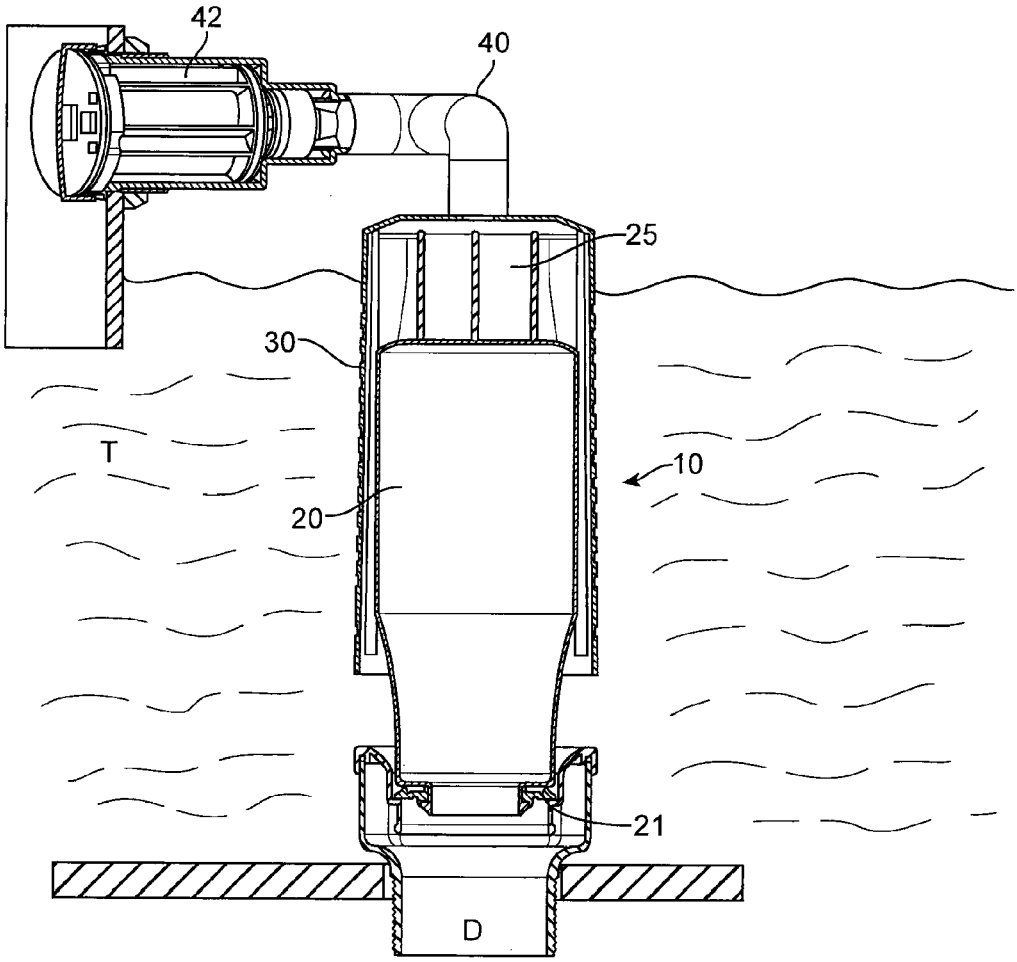
FIGS. 1 to 5 show sectional views of a simplified embodiment of the present invention such that its operation during a flush can be understood.

First, FIG. 1 shows a float assembly 10 positioned over a drain D in a toilet tank T. The toilet bowl (not shown) is positioned below drain D. Float assembly 10 comprises a buoyant float 20 that is moveable up and down within a housing 30. Water surrounds float assembly 10 prior to a flush. Float 20 seals drain D (thereby keeping water in tank T) when in its lowered position, preferably by way of a sealing member 21 wrapping around the open bottom end of the float, as shown.

Float 20 is hollow and has an open bottom end that traps air thereunder. Specifically, air is trapped within the open bottom end of float 20. An air chamber 25 is also found within housing 30 above float 20. An air passageway 40 is found that permits air trapped in air chamber 25 to move to the external ambient air when an actuator switch 42 is opened. Switch 42 is mounted onto the outside wall of the toilet tank (as shown), in the common position where a toilet flush handle is normally located. In various embodiments, air passageway 40 may comprise a tube extending to the exterior of the toilet tank, or it may simply comprise an air passageway that opens on the exterior of housing 30, such that the ambient air is the air within the tank.

Figure 2:
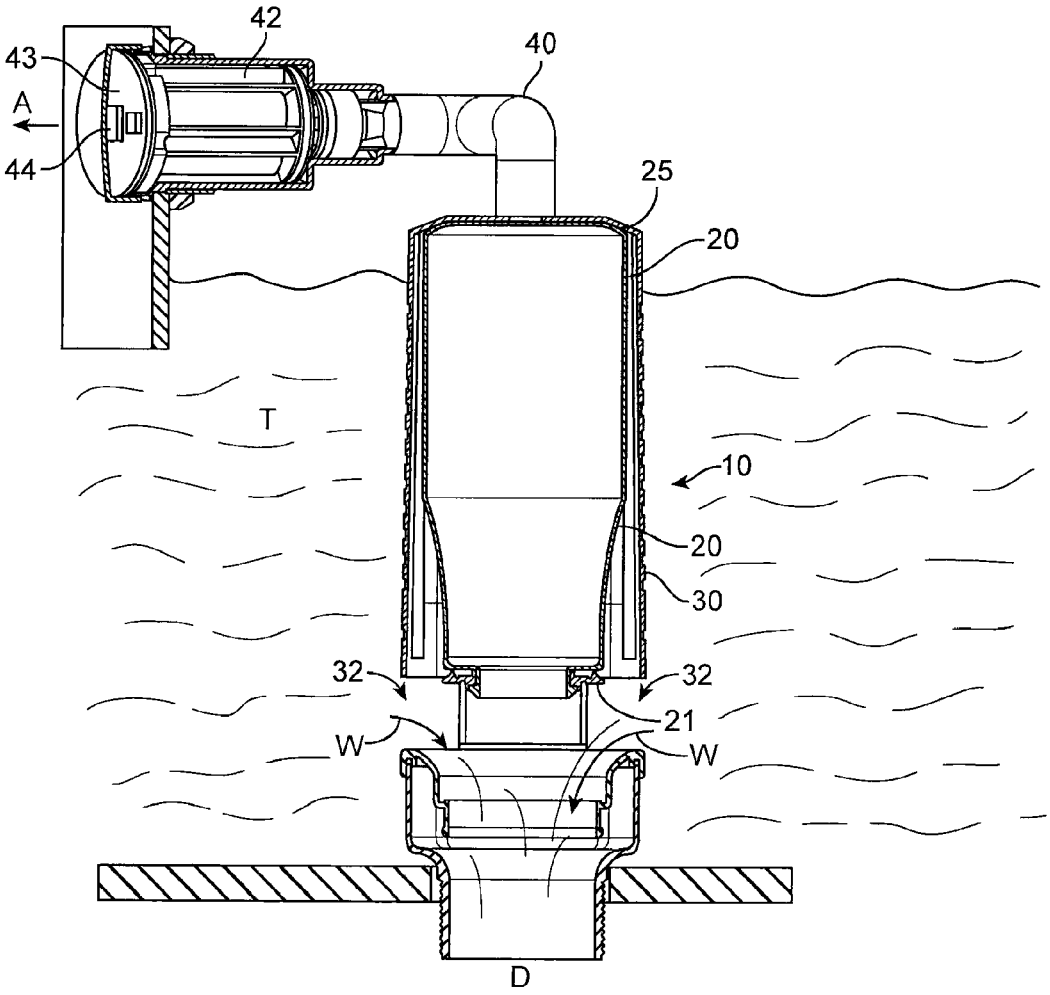

FIG. 2 illustrates the start of a flush. At this time, switch 42 is opened, permitting air A to move out of chamber 25 (i.e. out through passageway 40 exiting at or near switch 42). Since float 20 is buoyant, it will now move upwards in the surrounding water as the air escapes from chamber 25. As a result, the water W in tank T will then pass under float 20, down into drain D, and then down into the toilet bowl below. As a result, flushing commences. As can be seen in this sectional view, the bottom portion of housing 30 has flow openings 32 permitting tank water to pass therethrough and into the drain below the housing when the float assembly is in the raised position.

In various preferred embodiments, the switch 42 that selectively opens and closes the air passageway 40 may comprise a flush button 43 or lever positioned on the exterior of the toilet tank. Switch 42 may also optionally comprise a proximity sensor 44 positioned on the exterior of the toilet tank. An advantage of using such a proximity sensor is that a user need only put their hand near the switch 43 on the toilet tank to cause the toilet to flush.

In various optional embodiments, the air passageway 40 may connecting air chamber 25 in housing 30 to external ambient air by way of a tube extending from the housing to an external outlet on the toilet tank, as shown. Alternatively, the air passageway may simply be a passageway through to the external surface of housing 30, accessing external ambient air within the toilet tank itself. In this second embodiment, a flush actuation control switch or lever 42 will still be positioned on the exterior of the tank T for a user to flush the toilet.

If air passageway 40 is simply kept open after the flushing commences, float 20 will simply drop back into position to close drain D as the water in tank T empties. This is one method of normal contemplated operation. This method has the benefit of ease of operation as the only thing the system needs to flush the toilet is for switch 42 to open air passageway 40 and hold it open. After the water is fully drained from the tank, float 20 will fall along with this dropping water level, such that float 20 re-seals the opening to the drain. At that time, air passageway 40 can again be closed, sealing air within chamber 25, resulting in the return to the pre-flush position shown in FIG. 1.

Figure 3:
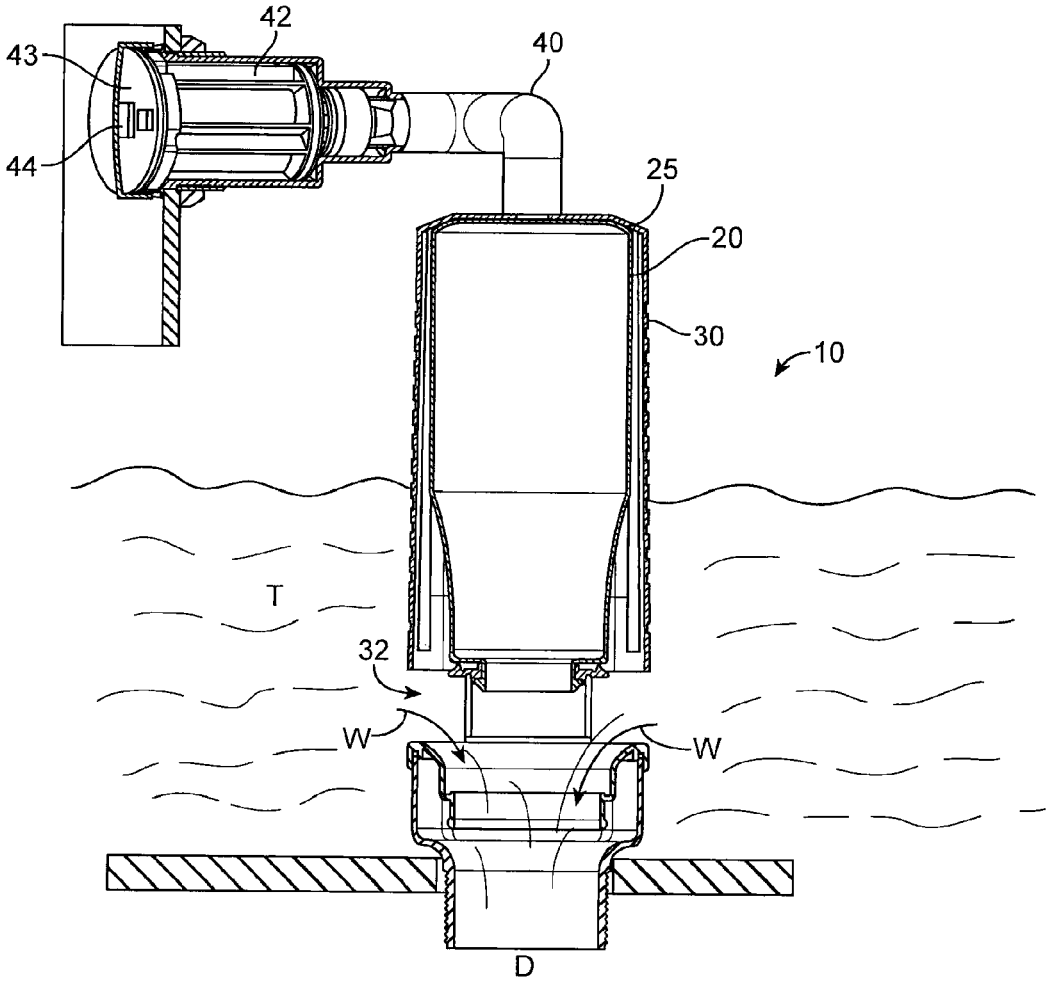
Figure 4:
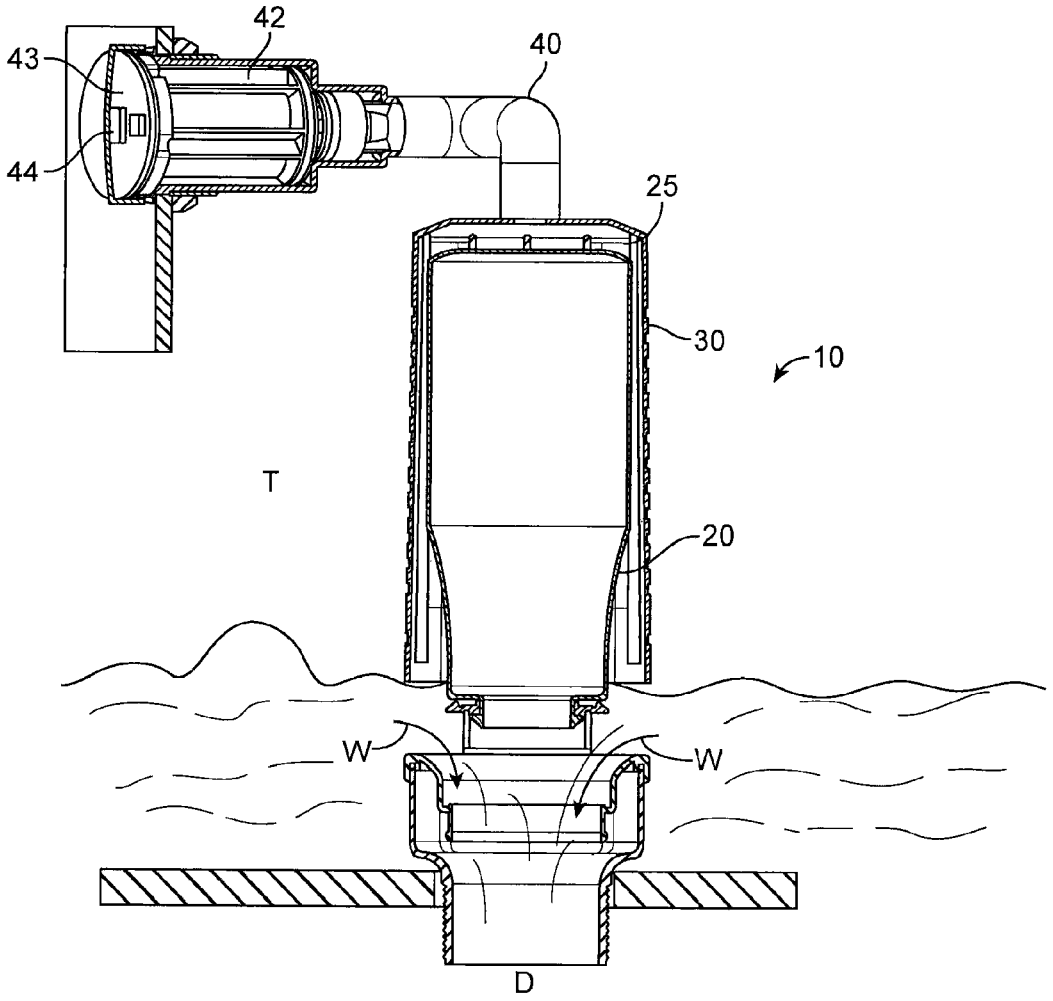
Figure 5:
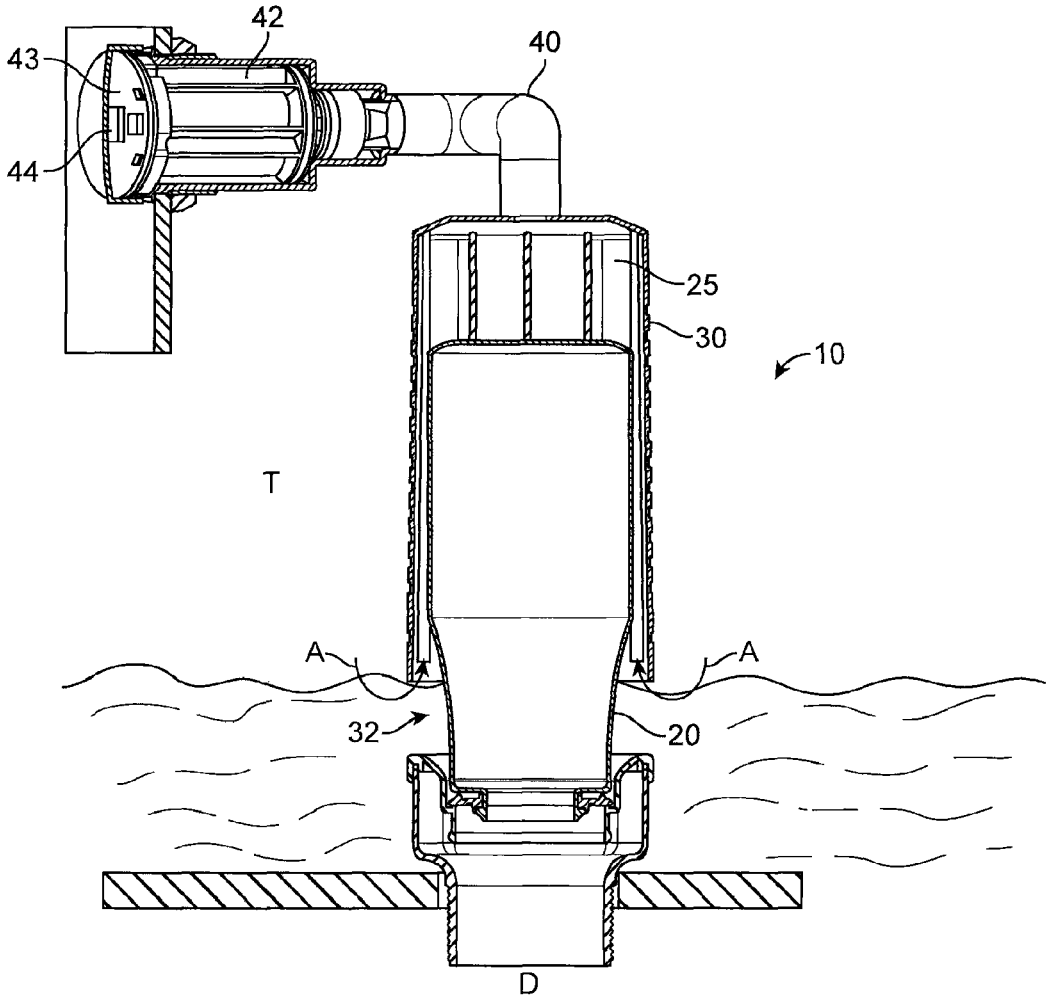

However, FIGS. 3 and 4 show another method of normal contemplated operation. Specifically, after the air has escaped from air chamber 25, switch 42 is closed, thereby preventing air from freely moving back from the external ambient environment into air chamber 25. As a result, a partial vacuum will form in air chamber 25, holding float 20 in a raised (or partially raised) position as the surrounding water level drops around housing 30. By holding float 20 upwards as the water level is falling around the float, the duration of the flush can be prolonged. Finally, as shown in FIG. 5, the water level in the tank will drop to such a low level that air A will break into the (partial) vacuum in air chamber 25 by entering the bottom end of air chamber 25. At such time, float 20 will then quickly descend, stopping the flush.

Stated another way, a prolonged flush can also be obtained by opening the switch 42 again to let air entering the air chamber and breaking the vacuum, the float 20 will drop and stop the flush. By altering the duration time between the first opening of the switch 42 and the second opening of the switch 42, the flush volume can be adjusted. The longer this time interval, the more volume will be discharged. The shorter, the less volume. This method can be used to control a full and partial flush.

As can be appreciated, by controlling the times when air passageway 40 is opened, the duration of the flush itself can be controlled. As a result, the flush volume can be controlled by keeping air passageway 40 closed (as shown in FIGS. 3 and 4) for a desired period of time after initially opening it (as shown in FIG. 2). For example, a full flush can be achieved by holding float 20 in its upward position until air enters the bottom of air chamber 25 as seen in FIG. 5. However, a partial flush may instead be achieved by simply permitting air to enter chamber 25 prior to this point in time (or even by allowing air to continuously enter the housing as was seen in FIG. 3). Therefore, by controlling the interval of time between the two openings of switch 42, the duration of time during which air can not flow freely through air passageway 40 is controlled. This controls the duration of the flush, which in turn controls the flush volume. A longer interval of time can correspond to a full flush and a shorter interval of time can correspond to a partial flush.

Figure 6:
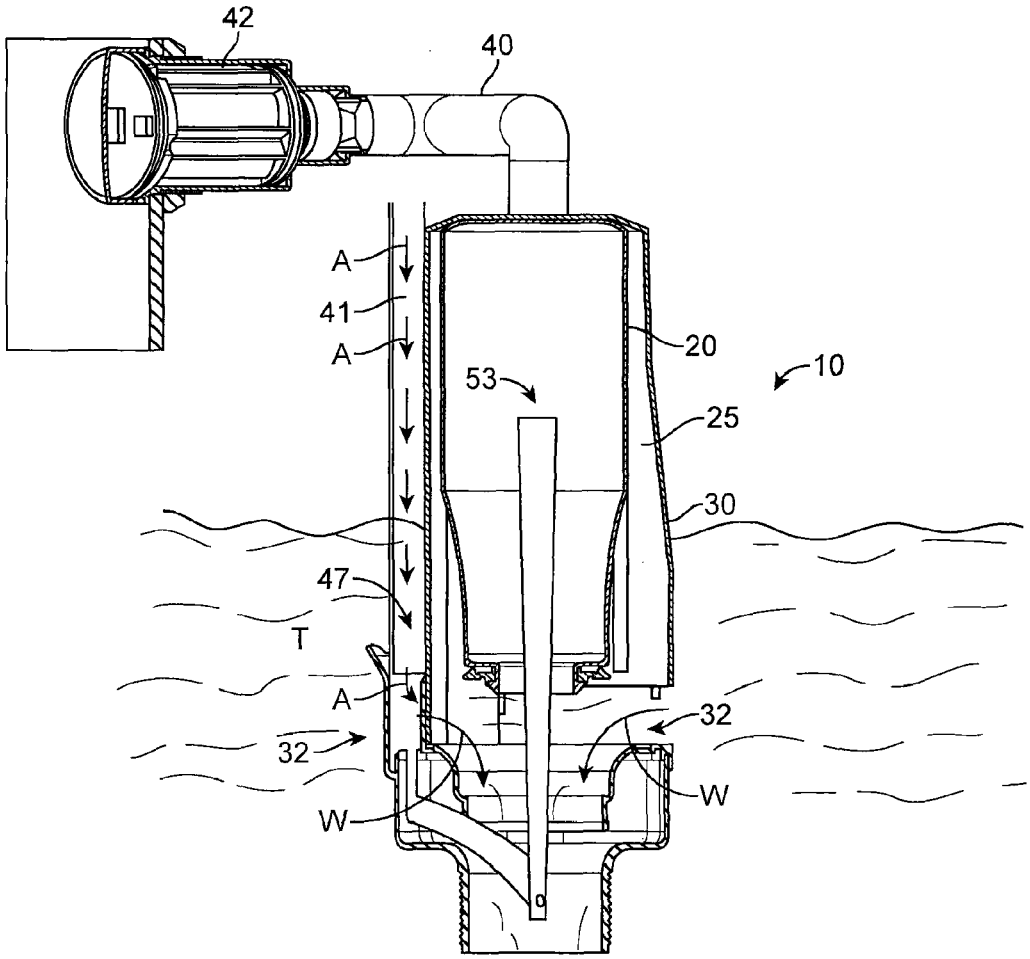
FIGS. 6, 7 and 8 show sectional views of an alternate embodiment of the invention having a venting system allowing air to freely pass from the interior of the float to the external ambient air.

FIG. 6 shows an alternate embodiment of the invention having a second air passageway 41 also connecting air chamber 25 in housing 30 to external ambient air. As can be seen, second air passageway 41 enters air chamber 25 at a tube end position 47 below where first air passageway 40 enters air chamber 25. As will be shown in several embodiments of the invention, a switch or other actuator can be used to selectively control the opening and closing of the second air passageway 41. As will also be shown, multiple air paths (at different heights) into air chamber 25 can also be used to control float movement.

In operation, this embodiment would be quite similar to the entering air chamber 25 as was seen in FIG. 5. However, in FIG. 6, the air would instead enter chamber 25 when the water lever is higher than it was in FIG. 5. Specifically, when the surrounding water level drops below position 47, air will enter air chamber 25 through second air passageway 41. This will break the vacuum in air chamber 25, causing float 20 to immediately drop. As a result, float 20 would drop sooner in FIG. 6 than in FIG. 5 (assuming air passageway 40 is kept closed in both cases). As can be appreciated, air A enters chamber 25 at the higher water line (i.e.: at 47) in FIG. 6 than the lower water line (i.e.: through lower flow openings 32) shown in FIG. 5. As a result, air passageway 41 may be selectively opened to result is a shorter flush (i.e.: a "partial" flush), whereas it may instead be kept closed to result in a longer (i.e.: "full" flush). It is to be understood that in accordance with the present invention, additional air openings may be provided to connect air chamber 25 to the external ambient air. These openings/air passageways may be at different heights and they may be selectively opened and closed at different times. All of this provides additional systems and approaches to control float buoyancy and flush times.

Figure 7:
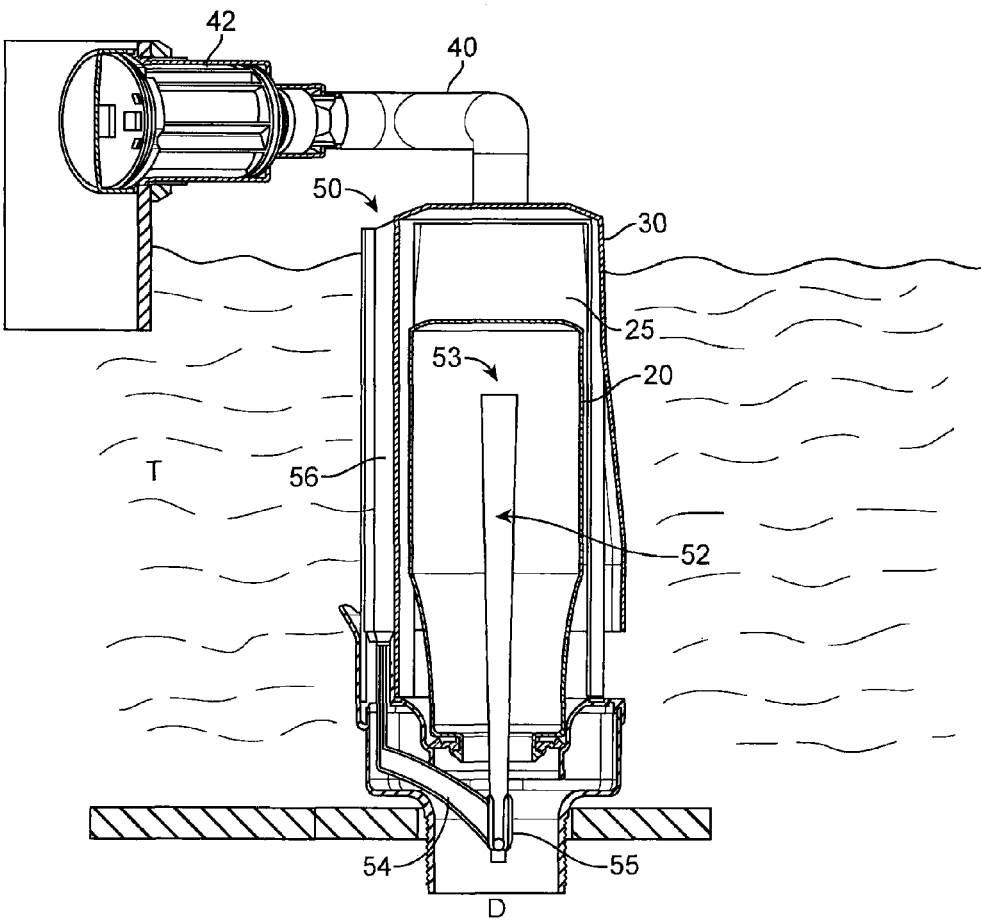
Figure 8:
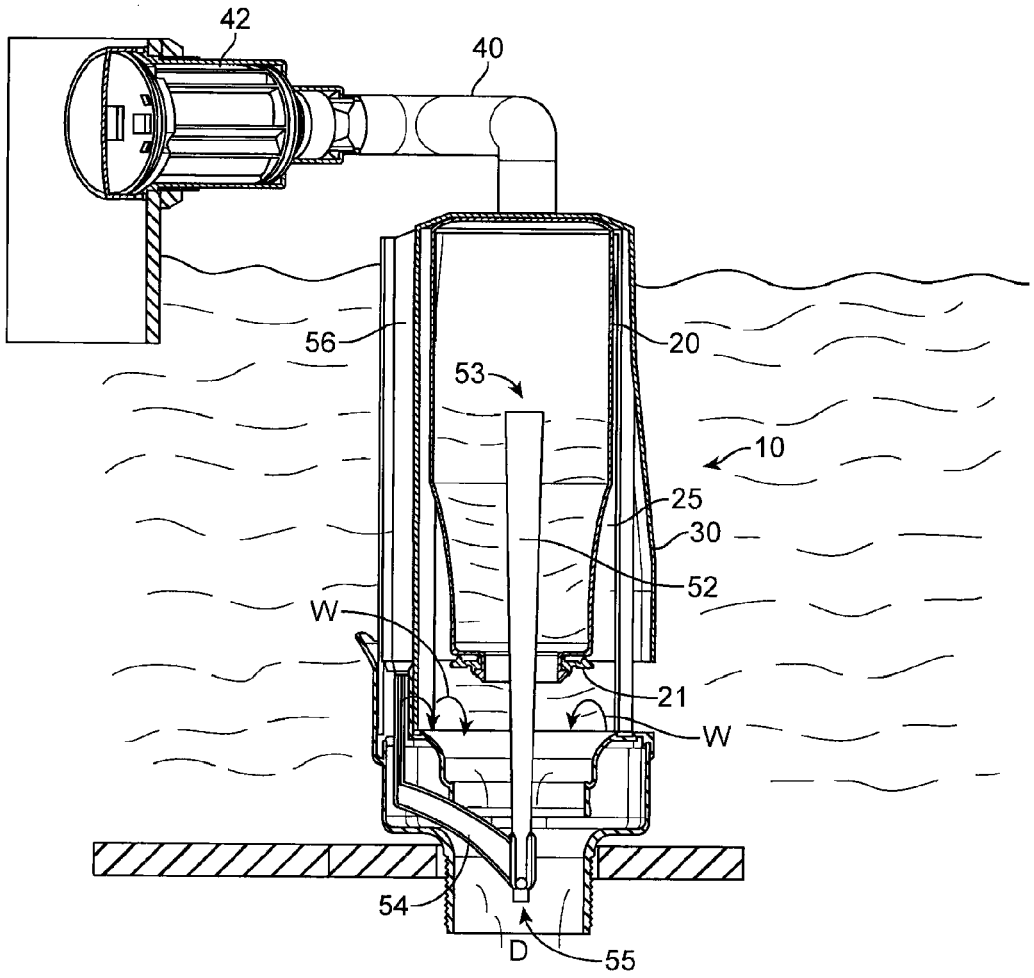

FIGS. 7 and 8 show an alternate embodiment of the invention having a venting system allowing air to freely pass from the interior of the float to the external ambient air, as follows. In various embodiments, an air passageway 50 between the interior of float 20 and the ambient air is provided. This air passageway 50 ensures that the air pressure within float 20 is kept at ambient conditions regardless of the water height in tank T. This makes it easier to calibrate the flushing sequence of operations, as will be explained.

In one embodiment, air passageway 50 comprises: a venting tube 52 having an open top end disposed within the hollow float 20; a venting base 54 connected to the bottom of venting tube 52; and a venting chamber 56 to the external ambient air. The venting chamber 56 is connected to venting base 54. Air flows freely between the venting tube 52, base 54 and chamber 56 such that the air in the interior of hollow float 20 remains at ambient pressure during a flush. It is to be understood that structures 52, 54 and 56 may be separate structures, or they may be portions of one long tubing flow path structure. For example, air passageway 50 may even be a single J-shaped structure (in which the lower end of the "J" is positioned within the float and the upper end of the "J" positioned outside or at the top of the housing 30. Note as well that venting tube 52 is different from the above described second air passageway 41 (i.e.: FIGS. 6 and 7 are rotated slightly from one another to show different exemplary embodiments of the invention).

In optional preferred embodiments, venting tube 52 has an open top end 53, which may be fluted outwardly as shown. Venting base 54 preferably has a bottom opening 55. Therefore, should any water in float 20 enter open top end 53, it will simply drain out through opening 55 into the drain below. Similarly, any tank water (accidentally) entering the top of venting chamber 56 will also drain out through bottom opening 55. As a result, water will be kept out of air passageway 50, permitting the free flow of air therethrough. In one optional embodiment, venting chamber 56 passes through a standard overflow tube 31 passing through housing 30 (as seen in FIG. 10).

FIG. 8 shows the water levels at the start of a flush. Specifically, once air passageway 40 is opened, the air will escape from air chamber 25 and float 20 will lift. At this time, the water will flow under the open bottom end of float 20 and pass down into the drain. Since air is free to flow from the inside of float 20 to the ambient air through air passageway 50, water will enter the bottom of the float, rising partially up into the interior of the float, as shown. Note: should the water level rise too far within float 20, the water will simply drain into open top end 53, and then down the drain through bottom opening 55.

Figure 9A:
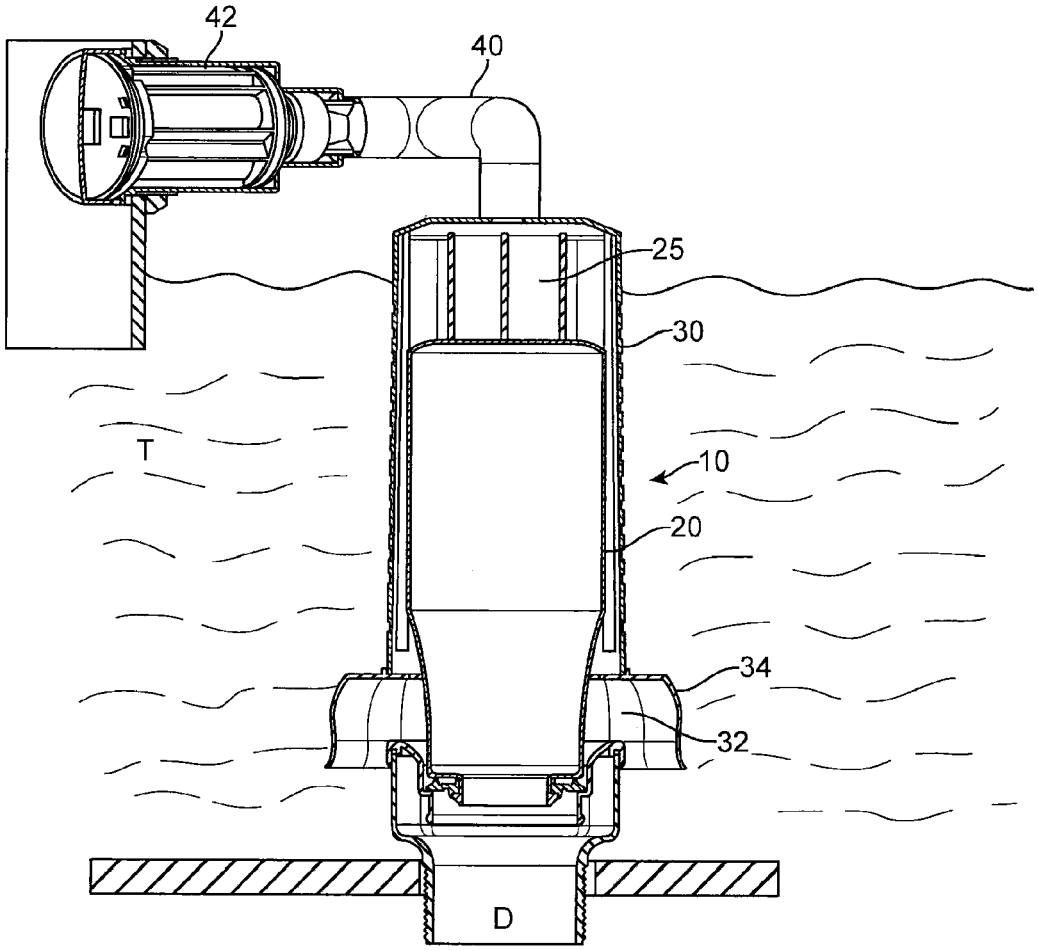
FIGS. 9A and 9B show an embodiment of the present invention having a siphon skirt.
Figure 9B:
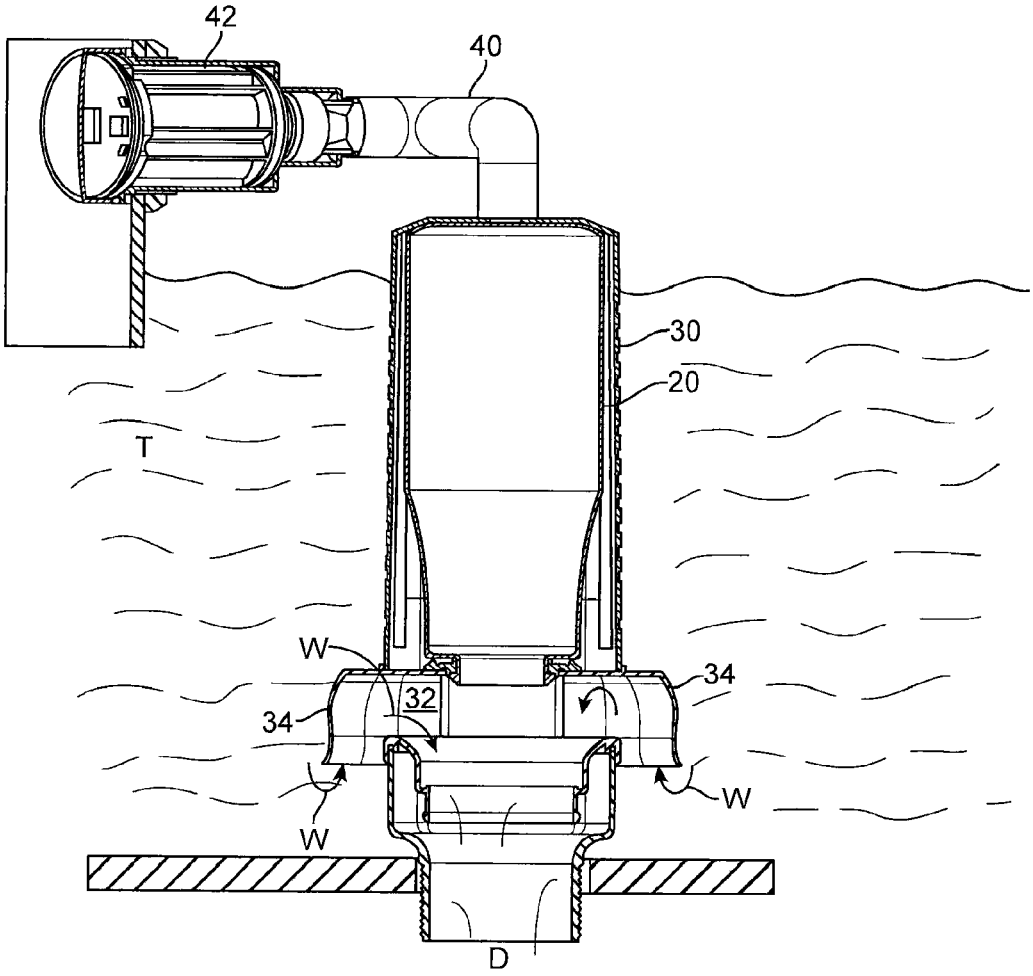

FIG. 9A shows a sectional view of an embodiment of the invention having a siphon skirt 34 prior to a flush. Siphon skirt 34 is disposed around the at least one flow opening 32. FIG. 9B shows the action of siphon skirt 34 during a flush. The siphon skirt 34 operates to pull tank water into the drain during the flush, thereby fully drawing almost all of the water out of the tank T. Specifically, the water level in the tank will be drained down to the level of the lower lip of the siphon skirt.

Figure 10A:
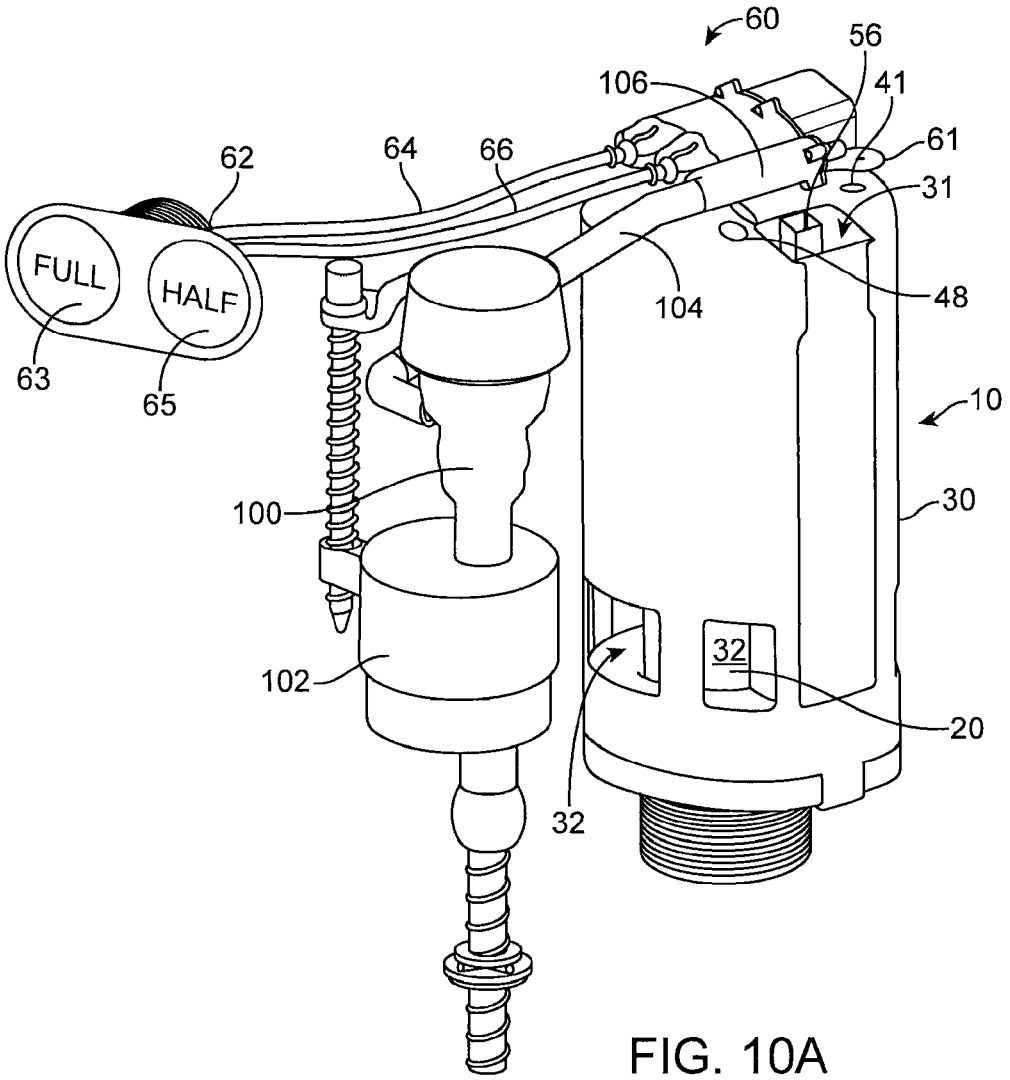
FIG. 10A is a perspective view of the present invention.

FIG. 10A is a perspective view of the present float assembly 10 positioned next to a fill valve 100. The operation of float assembly 10 is controlled by control module 60. Control module 60 includes an activation button panel 62 mounted on the outside of the toilet tank (not shown). Activation button panel 62 includes a full flush button 63 and a half flush button 65. Buttons 63 and 65 are connected (pneumatically or by cables) through lines 64 and 66 to control module 60. Fill valve 100 includes a float 102 and a water refill line 104. When the water level in the tank falls, float 102 falls, thereby turning on the fill valve 100 to supply water from the building mains through line 104 both into the tank T (to refill the tank) and into the housing 30 (through line 104 to activate a hydraulic cylinder 106 in the control module 60), as will be explained.

Control module 60 operates to rotate vent cover 61 so that it either opens or closes the top opening of second air passageway 41. As was explained with respect to FIG. 6, when second air passageway 41 is closed, a full flush occurs. However, when second air passageway 41 is open, air is instead able to enter air chamber 25 through at tube end position 47, resulting in a half flush. Hole 48 is a full flush vent hole which can best be understood by viewing FIG. 10B, as follows.

Figure 10B:
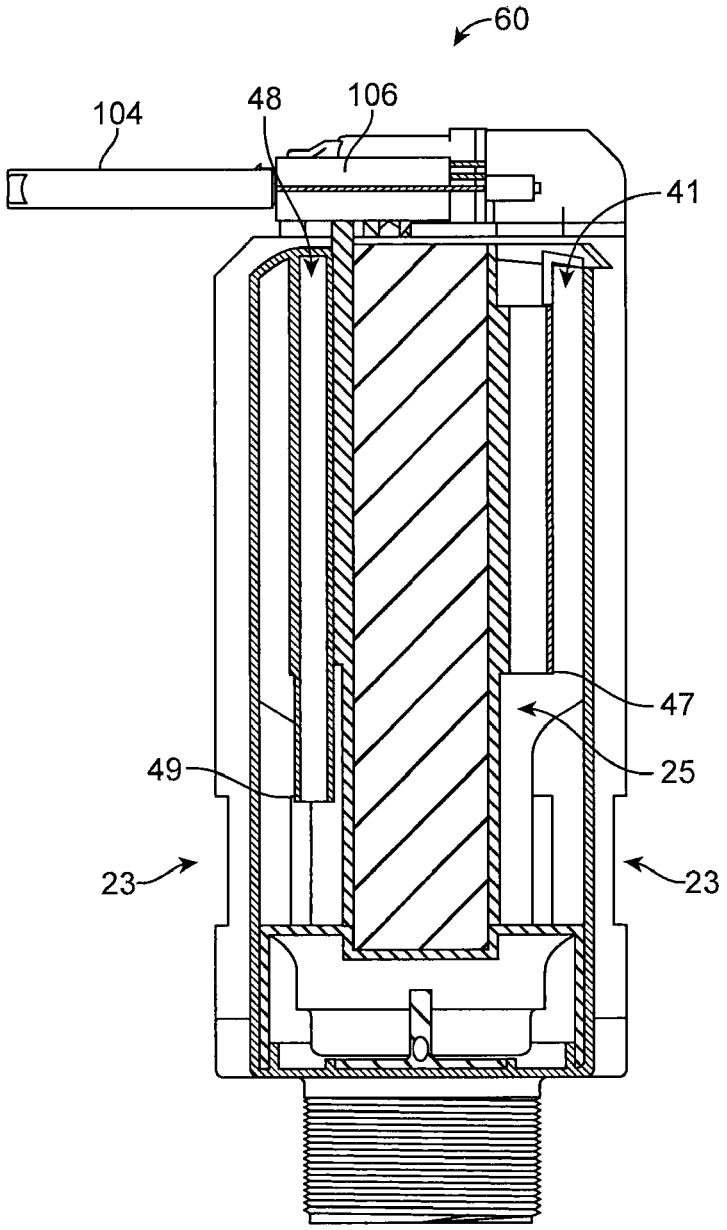
FIG. 10B is a sectional side elevation view of the interior of housing 30 showing the operation of the full and half venting systems.

As was explained above with regard to FIG. 6, second air passageway 41 permits a half flush (when the water drops to the level of tube end 47). At this time, when the water level drops to the level of tube end 47, air rushes into air chamber 25, breaking the vacuum and causing the float 20 to drop, stopping the flush. As seen in FIG. 10B, another air passageway is provided by hole 48, which extends down into a tube with an open bottom end at 49. When second air passageway 41 is closed, the water level will instead have to drop down to the level of tube end 49 before air rushes into air chamber 25, breaking the vacuum and causing the float 20 to drop, stopping the flush. Since end 49 is positioned below end 47, a greater volume of water will have to drain from the tank before air can pass through end 49. This greater volume of water is the "full flush".

Figure 11:
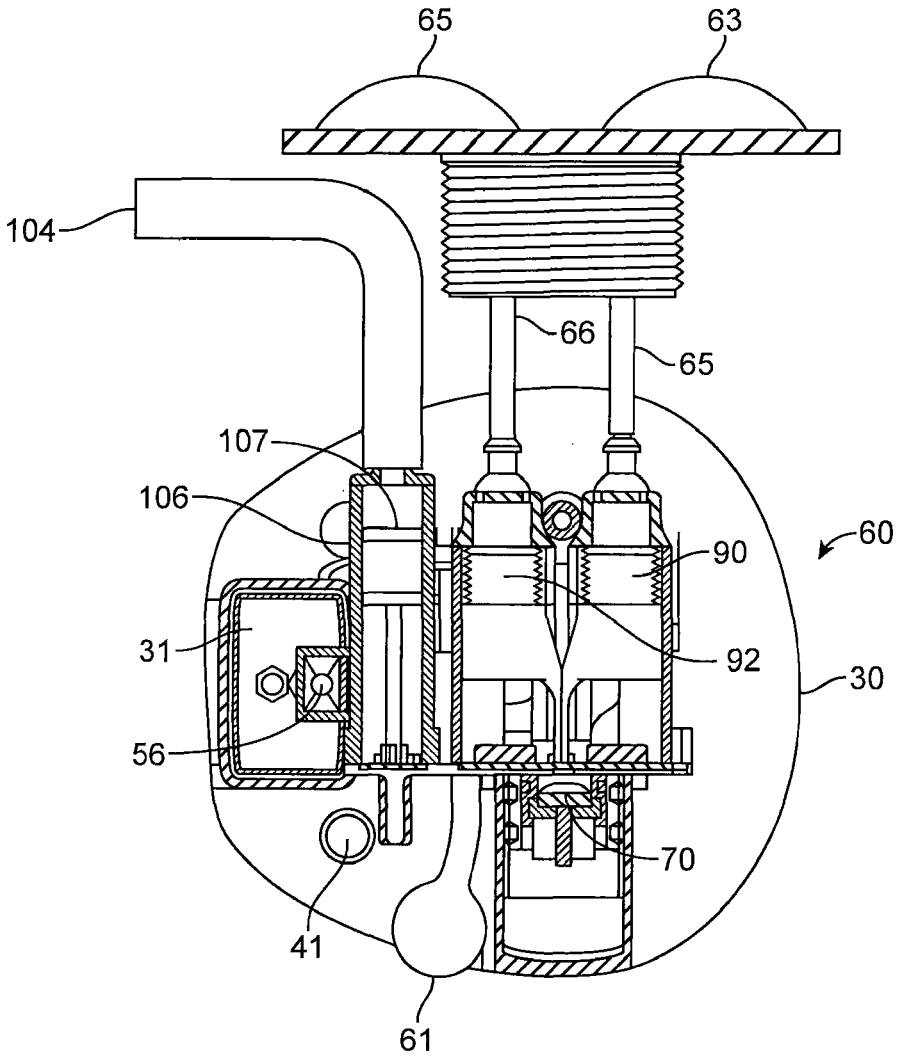
FIG. 11 is a top plan schematic of the control system of the present invention at rest.

Further details of the operation of control mechanism 60 are seen in FIGS. 11 to 14B, as follows. FIG. 11 is a top plan schematic of the control system of the present invention at rest. An air valve 70 is disposed on the top of housing 30. Air valve 70 is connected to air chamber 25 and acts to vent air directly out the top of housing 30 (to the ambient air within the tank) when opened. Thus, air valve 70 operates the same as switch 42 in the embodiments of the invention in FIGS. 1 to 9B. Simply put, opening air valve 70 permits air to escape from air chamber 25. As will be explained, control mechanism 60 controls the opening and closing of air valve 70 the same way that actuator switch 42 controlled the opening and closing of air passageway 40 (i.e.: valve 70 and switch 42 both let air out of air chamber 25 when opened). A piston 90 is moved by pneumatic tube 65 when button 63 is pushed. Similarly, a piston 92 is moved by pneumatic tube 66 when button 65 is pushed. The movement of the pistons 90 and 92 cause valve 70 to open.

Figure 12:
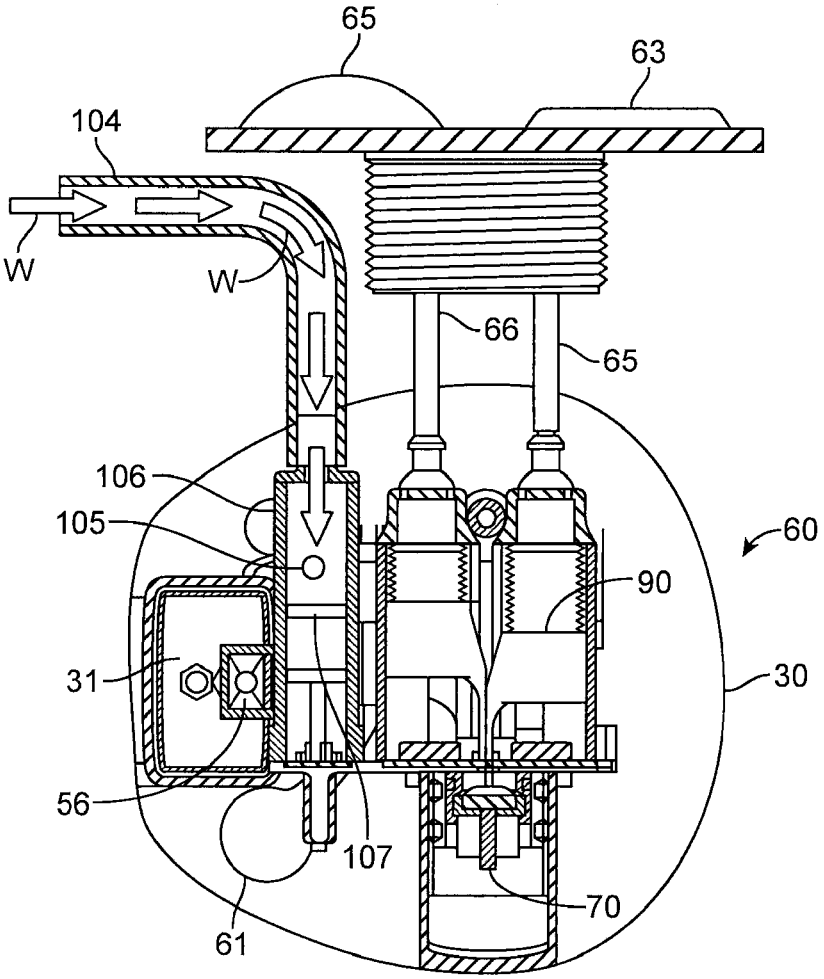
FIG. 12 is a top plan schematic of the control system of the present invention during a full flush.
Figure 14A:
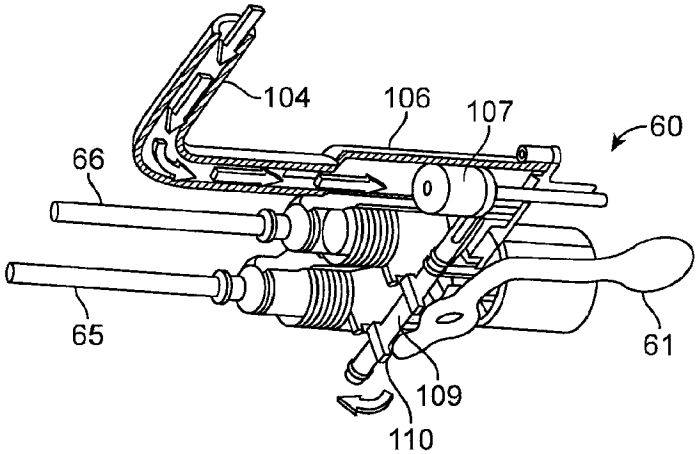
FIG. 14A is a bottom plan view of the control system during a half flush.
Figure 14B:
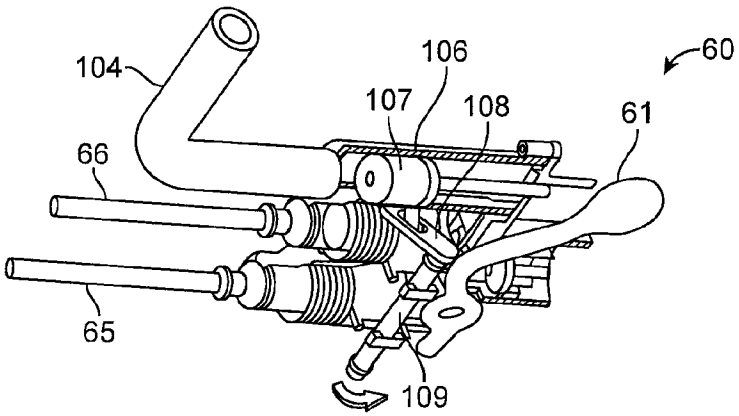
FIG. 14B is a bottom plan view of the control system during a full flush.

FIG. 12 is a top plan schematic of the control system of the present invention during a full flush (when pneumatic button 63 has been pushed). Pushing button 63 moves air through tube 65 which moves piston 92 which in turn opens valve 70. At this time, air begins to escape from internal air chamber 25 (through open valve 70 on the top of housing 30). As will be shown, control mechanism 60 rotates a crank 108 which rotates a cam 109 (FIGS. 14A and 14B). The rotation of cam 109 moves vent cover 61 into a position such that it closes second air passageway 41. This results in a full flush. At this same time, water is supplied through refill line 104, passing down into housing 30 through hole 105 into housing 30 to refill the tank.

Figure 13:
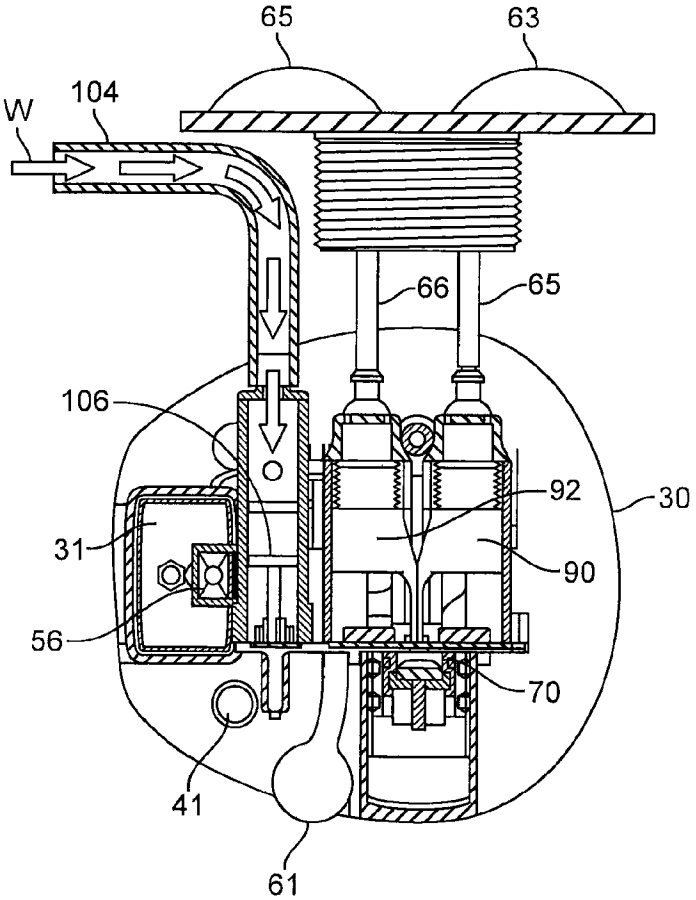
FIG. 13 is a top plan schematic of the control system of the present invention during water refilling.

FIG. 13 is a top plan schematic of the control system of the present invention when water is fed from one outlet of the fill valve to the hydraulic piston to power the piston. At this time, piston 107 is pushed back by the force of the refilling water such that cam 109 remains rotated to a position where its lugs 110 prevent movement of pistons 90 or 92. As a result, an operator is not able to push pistons 90 or 92 and is thus not able to open air release valve 70 during the re-filling of the tank.

For a half flush, button 65 is pushed so that air escaped from internal air chamber 25 (through open valve 70 on the top of housing 30). However, control mechanism 60 does not move vent cover 61 over second air passageway 41 in the case of a half flush. This results in the half flush since air is able to enter air chamber 25 through second air passageway 41 when the water level drops to the position of tube end 47 in FIG. 6.

FIG. 14A is a bottom plan view of the control system 60 during a half flush, and FIG. 14B is a bottom plan view of the control system 60 during a full flush, showing further structural details, as follows. As can be seen, the force of refill water passing through refill line 104 moves piston 107 to a retracted position (FIG. 14A). This in turn rotates crank 108 and cam 109 to lock pistons 90 and 92 to prevent them from opening air valve 70 (i.e.: by pushing buttons 63 or 65) when water is being supplied from a fill valve 100 into flush valve 10. This is necessary to maintain the partial vacuum in air chamber 25 prior to the desired time at which float 20 is to drop (and stop the flush). Once the hydraulic force on piston 107 has stopped, cam 109 will rotate back to its unlocked position such that a user is then free to push either of buttons 63 or 65 again.

Figure 15A:
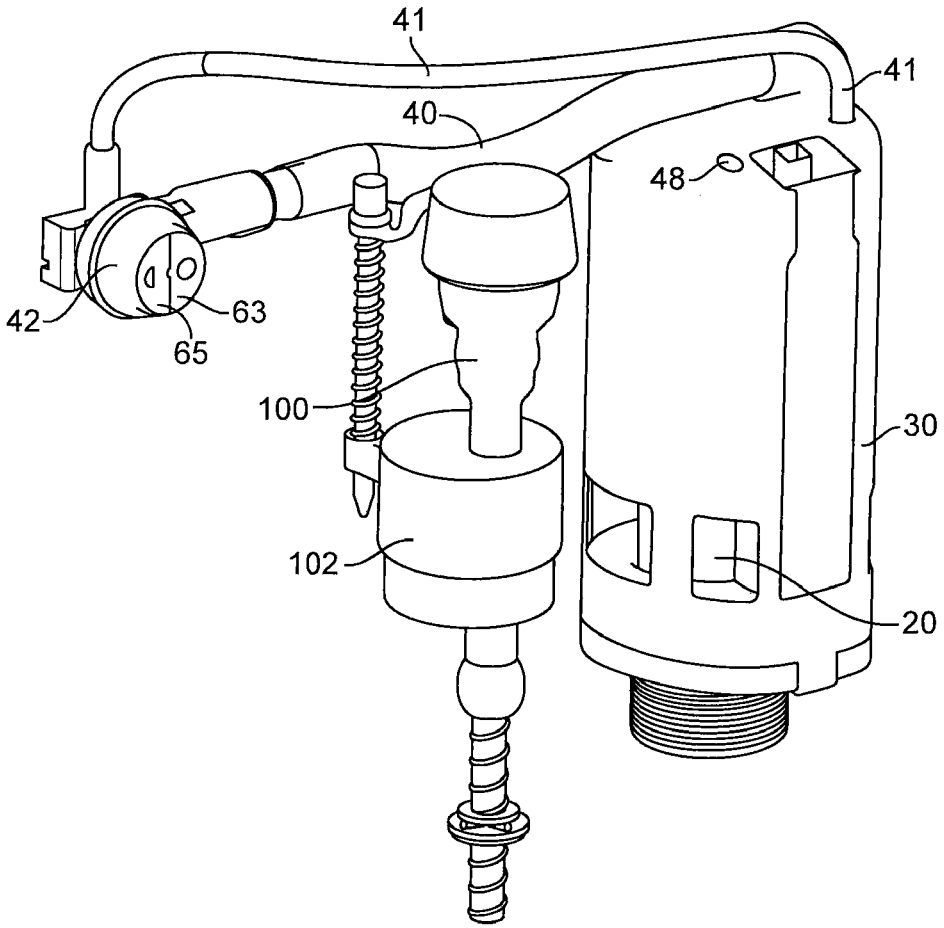
FIG. 15A is a perspective view of an alternate embodiment of the present invention.

FIG. 15A is a perspective view of an alternate embodiment of the present invention. This embodiment is similar in operation to that of FIG. 10A, however, air escapes back through switch 42 through passageways 40 and 41. Switch 42 comprises a full flush button 63 and a half flush button 65. When either of buttons 63 or 65 are pushed, air escapes from air chamber 25 by way of passageway 40 (as was explained with respect to FIGS. 1 to 5). When button 63 is pushed, a full flush is selected and air is blocked from moving through second air passageway 41. Conversely, when button 65 is pushed, a half flush is selected and air flows through second air passageway 41 (as was explained with respect to FIG. 10A).

Figure 15B:
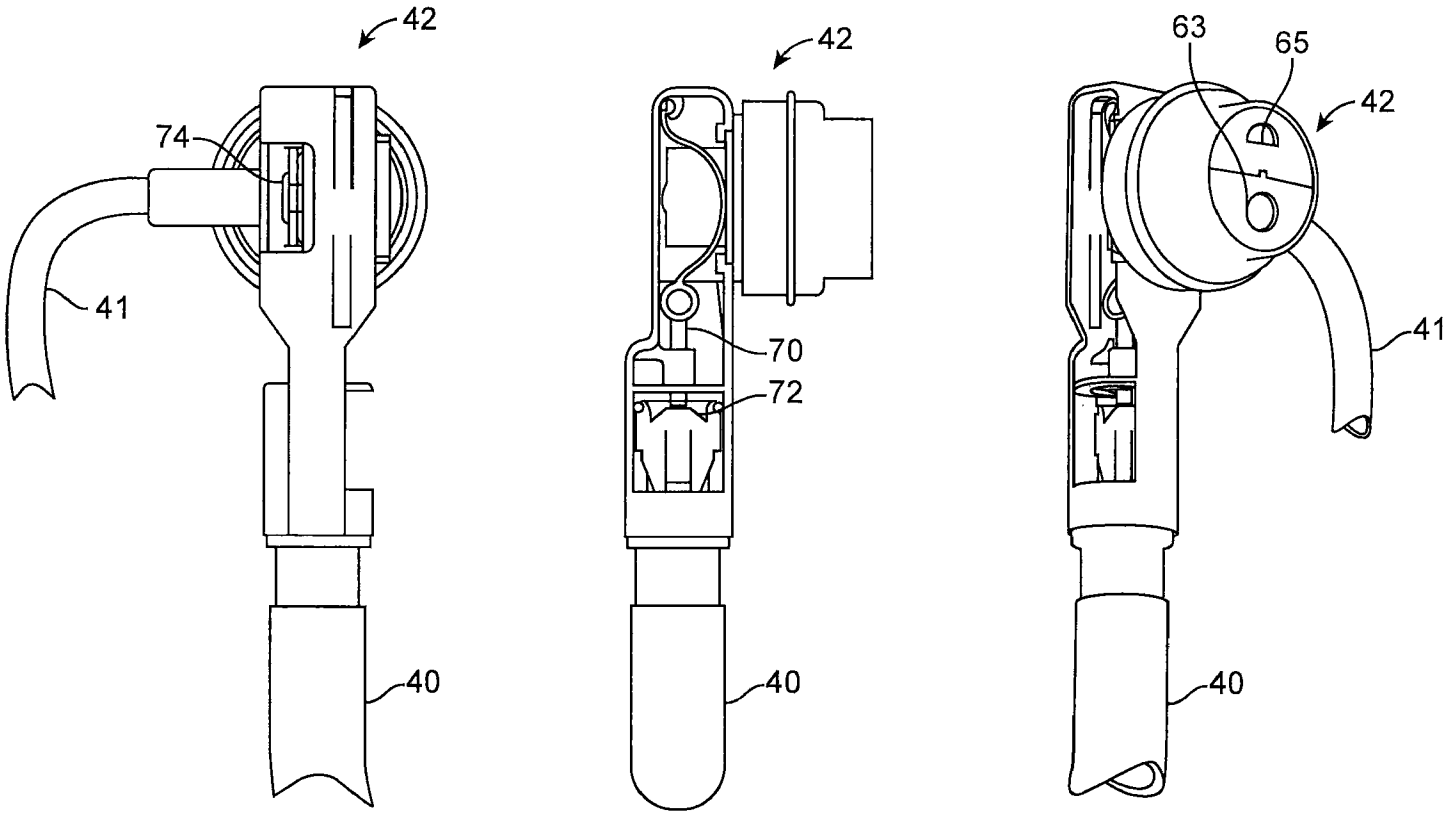
FIG. 15B is a close up of the flush control module of 15A prior to a flush.

FIG. 15B is a close up of three views of the flush control module 42 of 15A prior to a flush. At this time, passageway 41 is open for air flow. Flush control module 42 includes a valve pin 70 and a closed check valve 72.

Figure 15C:
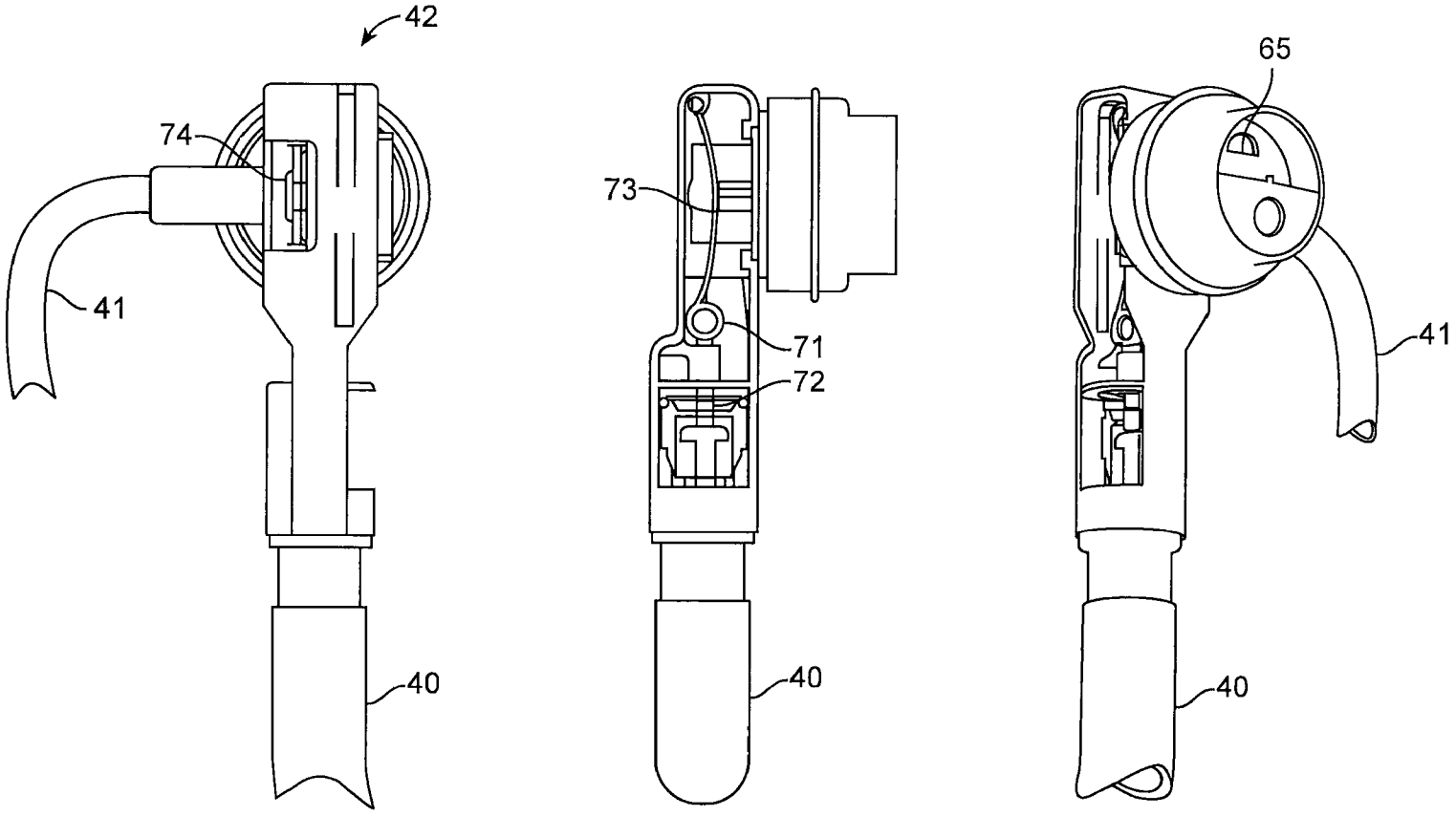
FIG. 15C is a close up of the flush control module of 15A during a half flush.

FIG. 15C is a close up of the flush control module 42 of 15A during a half flush when button 65 has been depressed. At this time, spring 73 will bend, pushing pin 70 down and opening check valve 72 (permitting the air to flow out of passageway 40, thus releasing air from chamber 25). At the same time, pushing the partial flush button 65 will open up the shuttle valve 74 and allow air to go through the passageway 41 (as was explained with respect to FIG. 10A).

Figure 15D:
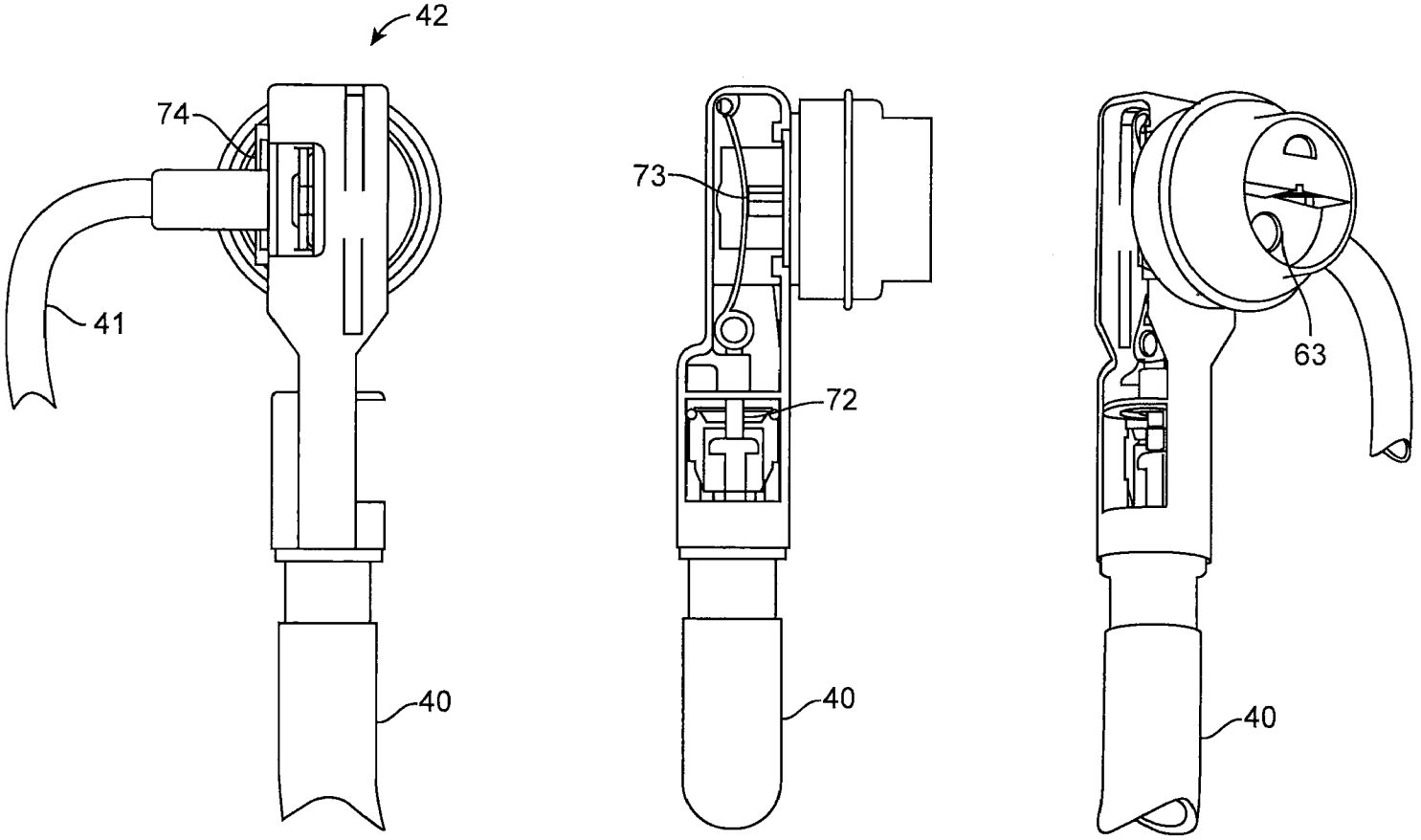
FIG. 15D is a close up of the flush control module of 15A during a full flush.

FIG. 15D is a close up of the flush control module 42 of 15A during a full flush when button 63 has been depressed. At this time, spring 73 will bend, pushing pin 70 down and opening check valve 72 (permitting the air to flow out of passageway 40, thus releasing air from chamber 25). At this same time, pushing button 63 will close the shuttle valve 74 and air is blocked from moving through second air passageway 41.

Figure 16A:
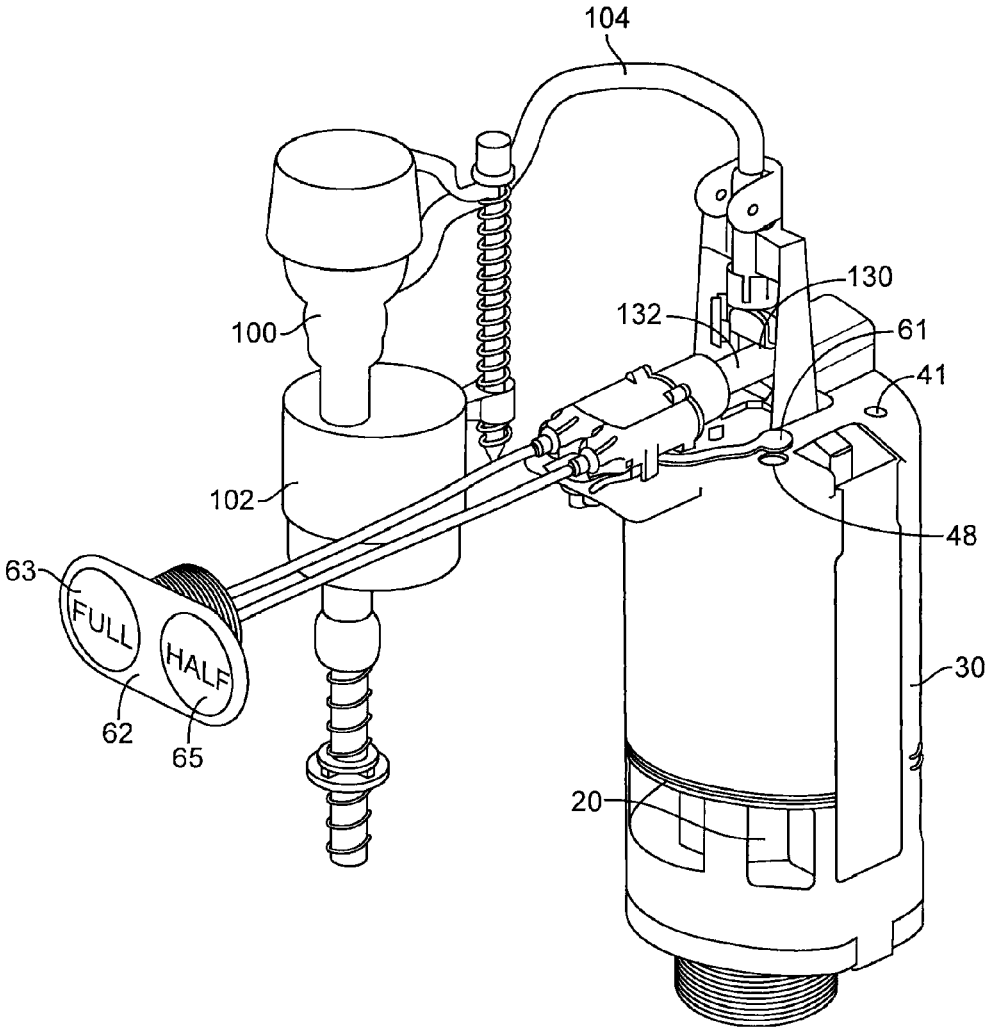
FIG. 16 A is a perspective view of an alternate embodiment of the present invention prior to a flush.
Figure 16B:
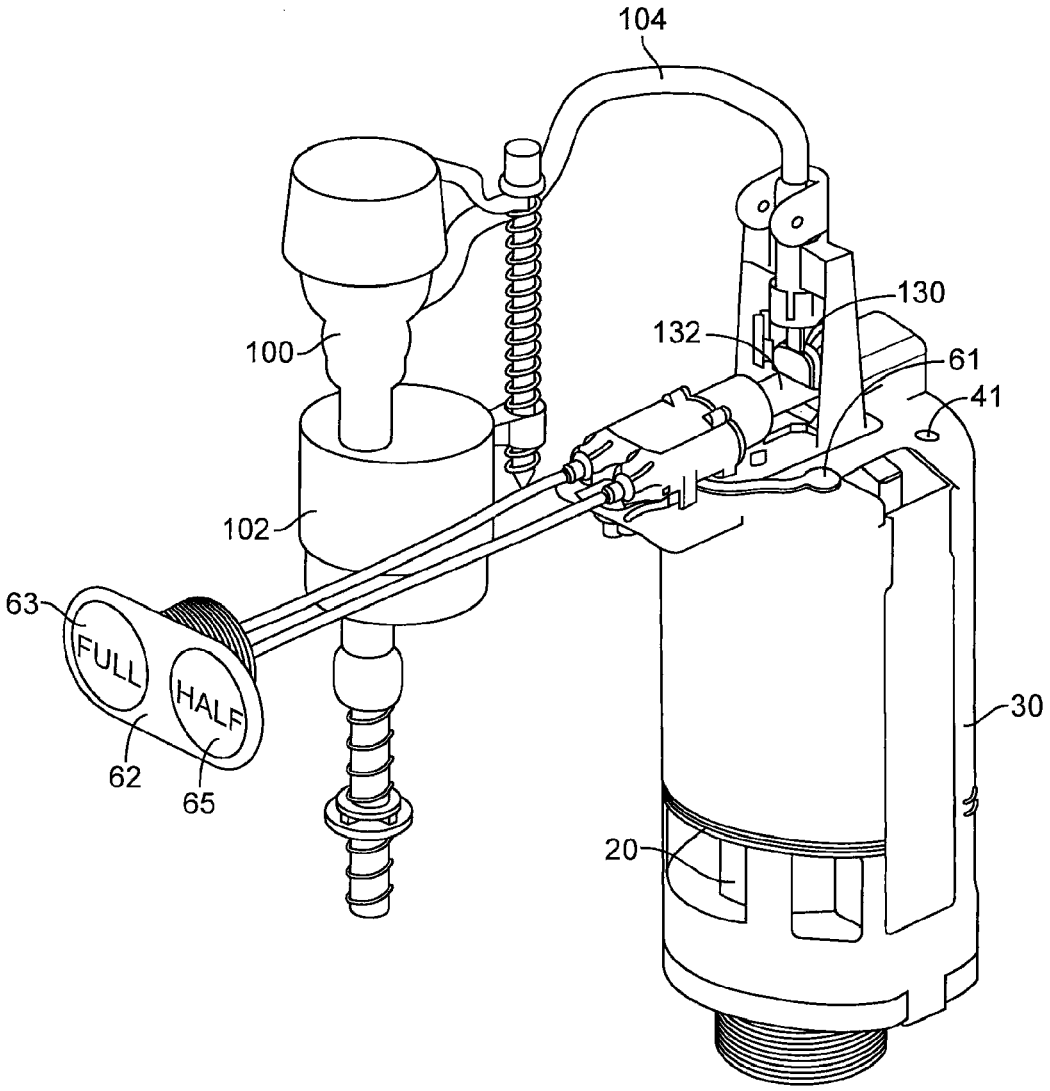

FIG. 16A is a perspective view of an alternate embodiment of the present invention in half flush mode; and FIG. 16B is a perspective view of this alternate embodiment of the present invention in full flush mode. This embodiment is also similar in operation to the embodiment previously described in FIG. 10A. However, the primary difference is that a hydraulic pinch valve 100 is provided. The operation of hydraulic pinch valve 100 is similar to the operation of the locking cam mechanism described in FIGS. 14A and 14B. Specifically, when refill water is entering housing 30 through refill tube 104, the force of the water will move the plunger in hydraulic pinch valve 130 down (see FIG. 16B) to choke off the flow of air through an air passageway tube 132. As a result, buttons 63 and 65 are disabled during the refilling of the tank. This prevents the operator from releasing air from air chamber 25 when the tank is refilling (similar to the function of lugs 110 in FIGS. 14A and 14B).

What is claimed is:

1. A flush valve, comprising:

(a) a housing dimensioned to be positioned over a drain in a toilet tank;

(b) a float assembly being vertically moveable within the housing, the float assembly configured to seal the drain when the float assembly is in a lowered position, and to open the drain when the float assembly is in a raised position, wherein the float assembly comprises a float having an open bottom end to trap air therein, and wherein an air chamber is formed between the interior of the housing and the exterior of the float assembly;

(c) an air passageway connecting the air chamber in the housing to external ambient air;

(d) an actuator for selectively opening and closing the air passageway; and (e) an air passageway continuously connecting the interior of the float to external ambient air through a flush cycle, thereby keeping the air pressure in the interior of the float at ambient pressure through the flush cycle.

2. The flush valve of claim 1, wherein the float assembly comprises a hollow float with an open bottom end.

3. The flush valve of claim 1, wherein the actuator for selectively opening and closing the air passageway comprises a flush button positioned on the exterior of the toilet tank.

4. The flush valve of claim 1, wherein the actuator for selectively opening and closing the air passageway comprises a triggering sensor.

5. The flush valve of claim 1, wherein the air passageway connecting the air chamber in the housing to external ambient air comprises a tube extending from the air chamber in the housing to an external ambient air outlet on the toilet tank.

6. The flush valve of claim 1, wherein the air passageway connecting the air chamber in the housing to external ambient air comprises a passageway through the housing to external ambient air within the toilet tank.

7. The flush valve of claim 1, wherein the air passageway continuously connecting the interior of the float to external ambient air comprises:

(i) a venting tube having an open top end disposed within the float;

(ii) a venting base connected to the bottom of the venting tube; and (iii) a venting chamber to the external ambient air, the venting chamber being connected to the venting base, wherein air flows freely between the venting tube, base and chamber such that the air in the interior of the float remains constant at ambient pressure.

8. A flush valve, comprising:

(a) a housing dimensioned to be positioned over a drain in a toilet tank;

(b) a float assembly being vertically moveable within the housing, the float assembly configured to seal the drain when the float assembly is in a lowered position, and to open the drain when the float assembly is in a raised position, wherein the float assembly comprises a float having an open bottom end to trap air therein, and wherein an air chamber is formed between the interior of the housing and the exterior of the float assembly;

(c) an air passageway connecting the air chamber in the housing to external ambient air;

(d) an actuator for selectively opening and closing the air passageway; and (e) an air passageway connecting the interior of the float to external ambient air, wherein the air passageway comprises:

(i) a venting tube having an open top end disposed within the float, (ii) a venting base connected to the bottom of the venting tube, and (iii) a venting chamber to the external ambient air, the venting chamber being connected to the venting base, wherein air flows freely between the venting tube, base and chamber such that the air in the interior of the float remains constant at ambient pressure, and wherein the venting chamber passes through an overflow tube passing through the housing.

9. The flush valve of claim 7, wherein the venting base has a bottom opening permitting water entering the venting tube to drain out through the venting base into the drain in the toilet tank.

10. The flush valve of claim 1, further comprising:

(f) a second air passageway connecting the air chamber in the housing to external ambient air, wherein the second air passageway enters the air chamber at a position below where the first air passageway enters the air chamber.

11. A flush valve, comprising:

(a) a housing dimensioned to be positioned over a drain in a toilet tank;

(b) a float assembly being vertically moveable within the housing, the float assembly configured to seal the drain when the float assembly is in a lowered position, and to open the drain when the float assembly is in a raised position, wherein the float assembly comprises a float having an open bottom end to trap air therein, and wherein an air chamber is formed between the interior of the housing and the exterior of the float assembly;

(c) an air passageway connecting the air chamber in the housing to external ambient air;

(d) an actuator for selectively opening and closing the air passageway; and (e) an air passageway connecting the interior of the float to external ambient air, wherein the air passageway comprises:

(i) a venting tube having an open top end disposed within the float;

(ii) a venting base connected to the bottom of the venting tube; and (iii) a venting chamber to the external ambient air, the venting chamber being connected to the venting base, wherein air flows freely between the venting tube, base and chamber such that the air in the interior of the float remains constant at ambient pressure, and wherein the venting base has a bottom opening permitting water entering the venting tube to drain out through the venting base into the drain in the toilet tank; and (f) an actuator for selectively opening and closing the second air passageway.

12. The flush valve of claim 11, wherein the actuator for selectively opening and closing the second air passageway comprises a pneumatic or cable activated control module.

13. The flush valve of claim 12, wherein the control module has a locking mechanism that prevents a user from opening the first air passageway when water is being supplied from a fill valve into the flush valve.

14. The flush valve of claim 12, wherein the control module has a locking mechanism that prevents a user from opening the second air passageway when water is being supplied from a fill valve into the flush valve.

15. The flush valve of claim 1, wherein the housing comprises:

at least one flow opening permitting tank water to pass therethrough and into the drain below the housing when the float assembly is in the raised position.

16. The flush valve of claim 15, further comprising:

a siphon skirt disposed around the at least one flow opening.

17. The flush valve of claim 1, wherein the float assembly comprises a sealing member between the float and the drain.

18. A method of controlling flow through a flush valve, comprising:

(a) providing a flush valve assembly comprising:

(i) a housing dimensioned to be positioned over a drain in a toilet tank;

(ii) a float assembly being vertically moveable within the housing, the float assembly configured to seal the drain when the float assembly is in a lowered position, and to open the drain when the float assembly is in a raised position, wherein the float assembly comprises a float having an open bottom end to trap air therein, and wherein an air chamber is formed between the interior of the housing and the exterior of the float;

(iii) an air passageway connecting the air chamber in the housing to external ambient air;

(iv) an actuator for selectively opening and closing the air passageway;

(v) a venting tube having one end disposed within the float wherein air flows freely in the venting tube between the interior of the float and external ambient air such that air pressure within the float remains at ambient conditions through a flush cycle; and (b) opening the air passageway, thereby permitting air to escape from the housing, thus permitting the float to rise, thereby causing a flush with water passing under the float and into the drain.

19. The method of claim 18, further comprising:

(c) subsequently closing the air passageway, thereby preventing air from entering the housing, thus preventing the float from falling, thereby prolonging the flush.

20. The method of claim 19, further comprising:

(d) controlling the interval of time between steps (b) and (c) to thereby select flush volume.

21. The method of claim 20, wherein a longer interval of time corresponds to a full flush and a shorter interval of time corresponds to a partial flush.

22. The method of claim 19, further comprising:

(d) subsequently opening the air passageway, thereby permitting air to enter the housing, thus permitting the float to fall, thereby ending the flush.

23. The method of claim 19, further comprising:

(d) while keeping the air passageway closed, permitting air to enter the housing, thus permitting the float to fall, thereby ending the flush.

24. The method of claim 18, further comprising providing a second air passageway connecting the air chamber in the housing to the external ambient air, wherein the second air passageway enters the air chamber at a position below the first air passageway, and (c) opening the second air passageway, thereby causing the float to fall.

25. A method of controlling flow through a flush valve, comprising:

(a) providing a flush valve assembly comprising:

(i) a housing dimensioned to be positioned over a drain in a toilet tank;

(ii) a float assembly being vertically moveable within the housing, the float assembly configured to seal the drain when the float assembly is in a lowered position, and to open the drain when the float assembly is in a raised position, wherein the float assembly comprises a float having an open bottom end to trap air therein, and wherein an air chamber is formed between the interior of the housing and the exterior of the float;

(iii) an air passageway connecting the air chamber in the housing to external ambient air; and (iv) an actuator for selectively opening and closing the air passageway;

(b) opening the air passageway, thereby permitting air to escape from the housing, thus permitting the float to rise, thereby causing a flush with water passing under the float and into the drain; and (c) providing a second air passageway connecting the air chamber in the housing to the external ambient air, wherein the second air passageway enters the air chamber at a position below the first air passageway, and (d) opening the second air passageway, thereby causing the float to fall, wherein opening the second air passageway corresponds to providing a partial flush, whereas keeping the second air passageway closed corresponds to providing a full flush.

26. A method of controlling flow through a flush valve, comprising:

(a) providing a flush valve assembly comprising:

(i) a housing dimensioned to be positioned over a drain in a toilet tank;

(ii) a float assembly being vertically moveable within the housing, the float assembly configured to seal the drain when the float assembly is in a lowered position, and to open the drain when the float assembly is in a raised position, wherein the float assembly comprises a float having an open bottom end to trap air therein, and wherein an air chamber is formed between the interior of the housing and the exterior of the float;

(iii) an air passageway connecting the air chamber in the housing to external ambient air; and (iv) an actuator for selectively opening and closing the air passageway;

(b) opening the air passageway, thereby permitting air to escape from the housing, thus permitting the float to rise, thereby causing a flush with water passing under the float and into the drain;

(c) subsequently closing the air passageway, thereby preventing air from entering the housing, thus preventing the float from falling; and (d) preventing the user from opening the air passageway during the time that water refills the toilet tank.

27. The method of claim 26, wherein a crank in the housing rotates a cam in the housing to move a piston to prevent the user from opening the air passageway during the time that water refills the toilet tank.

* * * * *